US005856807A

United States Patent [19]

Davis et al.

[11] Patent Number: 5,856,807

[45] Date of Patent: Jan. 5, 1999

[54] ANTENNA FOR A TWO-WAY RADIO

[75] Inventors: James Lynn Davis, Parkland; Robert W. Pennisi, Boca Raton, both of Fla.

[73] Assignee: Motorola, Inc., Schaumburg, Ill.

[21] Appl. No.: 780,515

[22] Filed: Jan. 8, 1997

[51] Int. Cl.[6] ..... H01Q 1/36

[52] U.S. Cl. ..... 343/702; 343/873

[58] Field of Search ..... 343/702, 872, 343/873, 895; 156/305, 294; H01Q 1/36, 9/04

[56] References Cited

U.S. PATENT DOCUMENTS

| | | | |
|---|---|---|---|
| 4,133,970 | 1/1979 | Lusk | 174/19 |
| 4,370,658 | 1/1983 | Hill | 343/713 |
| 4,435,713 | 3/1984 | Gasparaitis | 343/72 |
| 4,725,395 | 2/1988 | Gasparaitis et al. | 264/250 |
| 4,812,355 | 3/1989 | Yokoyama et al. | 428/215 |
| 5,352,517 | 10/1994 | Clough et al. | 428/357 |
| 5,426,719 | 6/1995 | Franks et al. | 395/2.37 |
| 5,557,286 | 9/1996 | Varadan et al. | 343/700 |

FOREIGN PATENT DOCUMENTS

| | | | |
|---|---|---|---|
| 1555-754 | 11/1979 | United Kingdom | 343/873 |
| 1555-756 | 11/1979 | United Kingdom . | |

*Primary Examiner*—Don Wong
*Assistant Examiner*—Tho Phan
*Attorney, Agent, or Firm*—Dale W. Dorinski

[57] ABSTRACT

An antenna (10) includes a radiating element (20) covered with a protective cover having a high dielectric constant polymer gel (15) located therein. The gel has a dielectric constant greater than 5, and is formed by swelling a polymer that has polar functional groups with a solvent that has a high dielectric constant. The gel is covered with a jacket (14) to contain the gel and provide physical protection.

14 Claims, 2 Drawing Sheets

ANTENNA FOR A TWO-WAY RADIO

CROSS REFERENCE TO RELATED APPLICATIONS

This application is related to pending U.S. application docket number CM 01108L, filed concurrently herewith, by Pennisi et al., entitled "High Dielectric Constant Gel," and assigned to Motorola, Inc.

FIELD OF THE INVENTION

This invention relates generally to antennas, and more particularly, to antennas for use with portable communication devices.

BACKGROUND OF THE INVENTION

Communication devices, such as portable radios, are undergoing increasing levels of miniaturization. A typical communication device usually includes an antenna used for receiving and transmitting signals. For communication devices operating in the VHF, UHF and sub-microwave radio frequency (RF) ranges, the wavelength of the radio frequency may range between 300 centimeters and 10 centimeters. The communication device requires an antenna of an appropriate length to enable reception or emission of such radio waves. For example, an antenna of simple construction would need to have a conductor having a physical length ranging between 5 and 150 centimeters to accommodate the wavelength of the above-mentioned frequency ranges. For communication devices requiring a compact packaging structure, it might be difficult to accommodate antennas of such lengths. Therefore, it is desirable to have designs which present a physically shorter antenna. There are many prior art approaches for achieving a shorter physical length antenna. These include the use of helically wound antenna elements, loop antenna elements, and other such designs of varying complexity. Oftentimes the antenna element is encased for aesthetics or physical protection, but the casing is known to reduce the performance of the antenna, such as reducing the radiation efficiency of the antenna.

One prior art approach is to coat the antenna with a high dielectric coating. High dielectric constant antenna coatings are desirable because the wavelength of the RF/Microwave radiation decreases as the dielectric constant increases. As a result, increasing the dielectric constant of an antenna reduces the antenna length and shrinks the overall antenna size. In the past, high dielectric constant coatings and substrates for antennae have been achieved through the addition of ceramic to low loss materials. Unfortunately, the addition of ceramic filler to materials such as polytetrafluoroethylene increases the stiffness of the material and reduces the flexibility. Typically, an antenna on a 2-way radio or cellular telephone should be flexible for user comfort and product longevity, so this solution is not desirable in these applications. Therefore the need exists to provide an small antenna for use with a portable communication device which provides an optimal amount of gain and low attenuation for a limited power level, while maintaining flexibility and other desirable physical attributes.

DETAILED DESCRIPTION OF THE PREFERRED EMBODIMENT

One factor which greatly affects antenna performance is the material used in it's construction. It is important to have an antenna which is strong and durable. The antenna must also perform effectively and the materials selected should not degrade it's operating parameters. In many applications, such as portable radios, an insulating dielectric is required around the antenna in order to provide improved mechanical integrity and to increase product safety. In addition to electrical requirements, a coating used on a portable radio antenna should meet a number of mechanical parameters including high durability, flexibility, high and low temperature performance and chemical resistance.

Traditionally, these antennas have been coated with urethane materials due to their excellent mechanical properties. Urethanes are commonly used in various two-way radio and cellular antennas. This technology is discussed in U.S. Pat. Nos. 4,435,713 and 4,725,395 assigned to Motorola, Inc., and which are incorporated herein by reference. As is known in the art, polyurethane elastomers possess desirable mechanical properties for antenna coating applications while possessing dielectric properties such as a frequency dependent dielectric constant ($e_r$) and a high loss tangent (tan d). The dielectric properties of polyurethanes can be traced to the large number of polar groups (i.e., C–O, C=O, C–N, CƒN) in the polymer. These polar groups create a strong molecular polarizability which increases the dielectric constant. Further, these strong dipoles are also responsible for the high loss tangent (tan d). As an applied field oscillates, the molecular polarizability oscillates in conjunction with that field due to the torque the electric field places on the molecular dipole. In an ideal situation, the molecular dipole would exactly follow the electric field, which would result in complete energy storage. However, as the frequency of the electric field oscillation increases, the molecular dipole cannot exactly follow the field and begins to lag behind. The angle between the lagging molecular dipole and the driving electric field is denoted as d and the loss tangent (tan d) is given by the ratio of the complex part of the dielectric constant (i.e., absorptive term) divided by the real part (i.e., energy storage term). When tan d>0 energy is dissipated in the material since the dipole moment cannot exactly follow the electric field. Hence, the dielectric possesses an absorption term in addition to an energy storage term when tan d>0.

Figure 1:
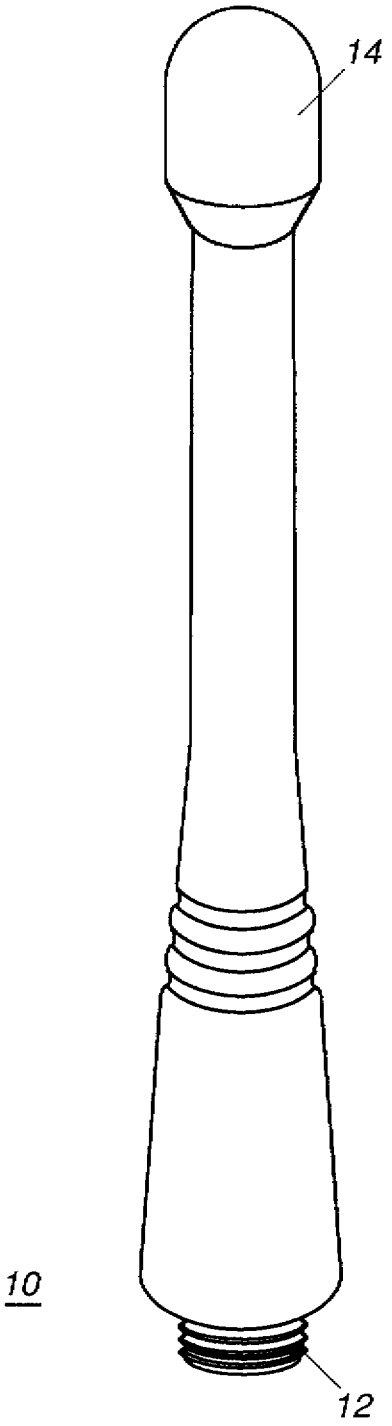
FIG. 1 is an isometric view of an antenna in accordance with the invention.
Figure 2:
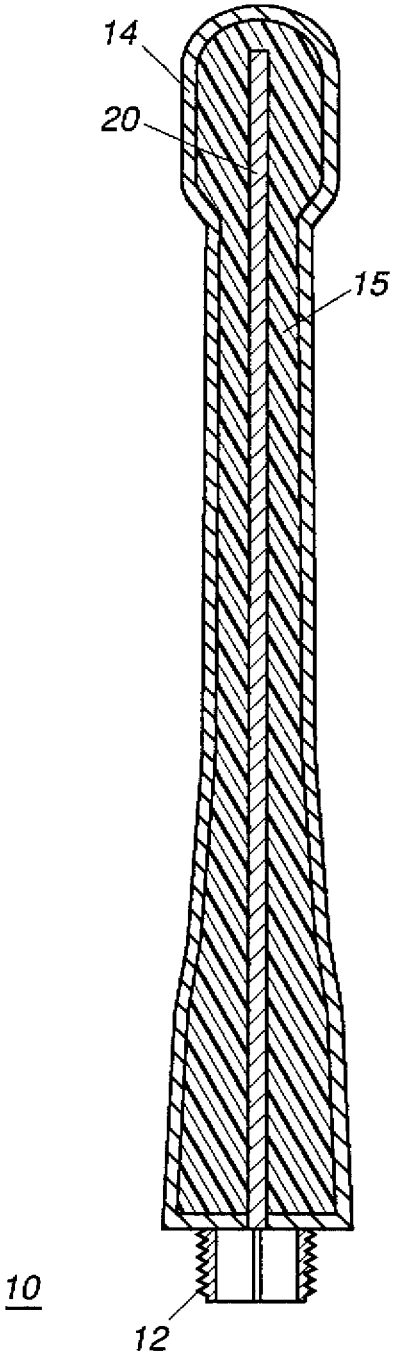
FIG. 2 is a cross sectional view of FIG. 1, taken vertically through the center.
Figure 4:
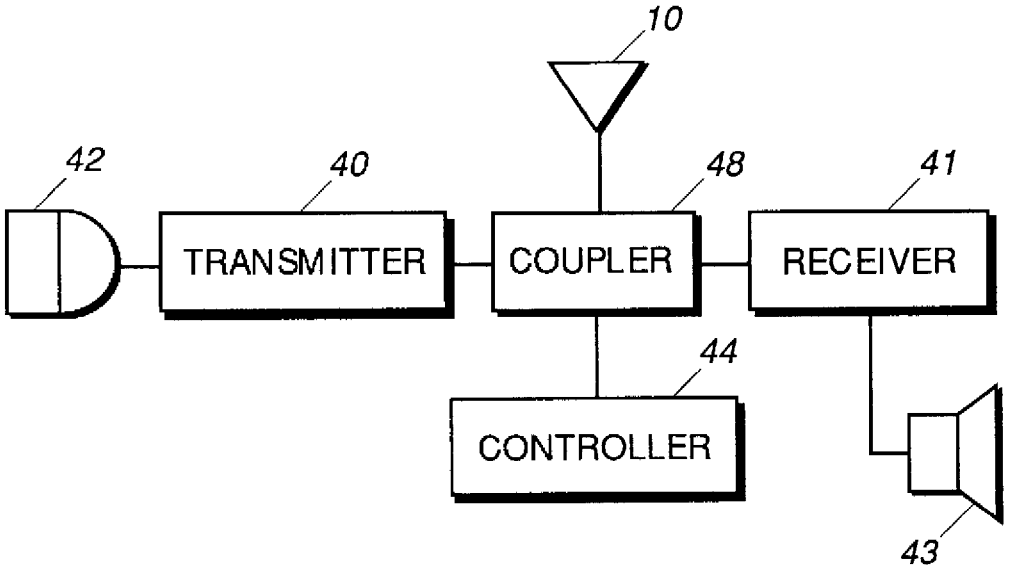
FIG. 4 is a schematic diagram of a two-way radio in accordance with the invention.

The invention will now be described in conjunction with the drawing figures. An antenna for a portable radio contains a center metallic conductor, an outer polymer shell chosen from a material such as polyolefin or polyurethane, and a high dielectric constant gel material between the center conductor and the outer polymer shell. Referring now to FIGS. 1 and 2, an isometric view and a cross sectional view, respectively, of an antenna 10 such as an end-fed antenna, a sleeve dipole antenna, or a quarter-wave whip antenna is shown. The antenna 10 includes a radiating element 20 coupled to a connector 12. This connector 12 is used for the mechanical and electrical coupling of the antenna 10 to a transmitter 40 (FIG. 4). The radiating element 20 is used to radiate a radio frequency signal at a desired power level generated by the transmitter 40 and coupled thereto via the connector 12. The radiating element 20 radiates energy in all directions, hence rendering the antenna 10 isotropic. The radiating element may be a straight conductor, a braided conductor, a metal foil conductor or a helical conductor.

Covering all or a portion of the radiating element 20 is a protective jacket or cover 14. This cover 14 substantially covers the length of the radiating element 20. Indeed, in many applications the cover 14 extends well beyond the radiating element 20. An absorptive material, such as a high dielectric constant polymeric gel 15 is disposed around the radiating element 20 and is contained within the cover 14, in order to enhance the radiation of radio frequency energy. The high dielectric constant polymer gel is made by swelling solvents that have a high dielectric constant into a polar polymer to form a gel. The polar polymer contains functional groups that are polar in nature. Useful polar polymers are those having one or more functional groups such as acetamide, hydroxyl, carbonate, anhydride, carboxylic acid, esters, imides, amides. The reader will appreciate that a variety of other polymers having appropriate functionality will also find use in the invention. The purpose of these polar functional groups is to aid in solubilizing the polymer into the high dielectric constant solvent, since all the candidate solvents necessarily have a relatively high degree of polarity. Some useful polar polymers include, but are but not limited to, polymethyl methacrylate (PMMA), polyacrylamide, polyacrylic acid (PAA), polyvinyl alcohol (PVA), polycarbonate diol (PCD), and polyethylene glycol (PEG). All of these materials have one or more polar moieties present either as endgroups or at other locations on the polymer chain. The polar polymer is then swelled to create a gel by dispersing a high dielectric constant polar organic solvent throughout the polymer matrix. In the preferred embodiment, the solvent has a dielectric constant greater than 20. Useful polar organic solvents are those containing hydroxyl, amide, nitrile, carbonate, sulfate and sulfoxide moieties. Table I lists some useful solvents, along with their dielectric constants.

TABLE I

| | |
|---|---|
| 1,3-butanediol | 33.0 |
| 1,4-butanediol | 28.1 |
| 3-butene nitrile | 28.1 |
| acetamide | 59.2 |
| acetonitrile | 37.5 |
| bis (2-hydroxyethyl) ether | 31.7 |
| dimethyl sulfoxide | 48.9 |
| dimethyl sulfate | 48.3 |
| ethylene carbonate | 89.6 |
| ethylene glycol | 37.0 |
| formamide | 111.0 |
| glycerol | 42.5 |
| lactonitrile | 38.0 |
| N,N-dimethylacetamide | 37.8 |
| N,N-dimethylformamide | 38.3 |
| N-methylacetamide | 178.9 |
| N-methylformamide | 200.1 |
| N-methylpropionamide | 185.0 |
| phthalide | 36.0 |
| propylene carbonate | 64.0 |
| tetrahydrothiophene oxide | 42.5 |
| xylitol | 40.0 |
| water | 80.4 |

Optionally, a non-polar polymer can also be added to the polar polymer to further enhance the properties. Some examples of non-polar polymers are polyethylene (PE), polypropylene (PP), polytetrafluoroethylene (PTFE), dimethylpolysiloxane or polyethylene oxide (PEO). These non-polar polymers typically have the physical properties (flexibility, impact resistance, tear resistance, environmental resistance) that are desirable for many applications, but they cannot be blended alone with the high dielectric constant solvents, because they are non-polar and would not be compatible with the solvents. Those skilled in the art will appreciate that these materials cannot absorb significant amounts of the desired high hydrogen bonding solvents, and thus their use as high dielectric constant polymers has been highly restricted in the past. Additives can also be blended into the mixture to achieve additional electrical, mechanical and/or rheological performance. The final dielectric properties of the swollen gel polymer network are determined by the amount and selection of the absorbing solvent.

In the preferred embodiment of the invention, the cover 14 encases both the radiating element 20 and the gel 15. In order to maintain excellent mechanical and dielectric performance, the cover material should be flexible, abrasion resistant, chemical resistant, and possesses appropriate dielectric constant ($e_r$) and loss tangent (tan d) values. Examples of materials which can be used as covers include, but are not limited to, ethylene propylene rubbers, ethylene propylene diene monomer, ethylene a-olefins, ethylene copolymers, propylene copolymers, polyethylene, polypropylene, silicones, polystyrene, polyurethanes, isocyanurates, ionomers, polyesters and similar materials.

A preferred embodiment of this invention consists of an antenna containing a gel created by adding PMMA to propylene carbonate. The gel contained approximately 70% by weight of the polymer, and was a viscous mixture. This gel has a significantly higher dielectric constant than the neat polymer, and thus a high dielectric constant gel can be made by dissolving a polymer in a high dielectric constant solvent. Clearly, the dielectric properties of the gel will be dependent upon the relative proportions of the polymer, the solvent and any additives. Increasing the percentage of solvent will increase the dielectric constant of the resulting gel, while increasing the proportions of the polymer will decrease the dielectric constant.

Additional examples of our invention were made using different polymers and solvents. A gel containing 60% by weight of PAA and 40% glycerol was formulated and tested in the cell as described above. Another example of our invention was made using 90% PCD and 10% water. Judicious selection of the polymer and the solvent, and the respective amounts of each in the gel, will allow the chemist to formulate a material to a wide variety of desired dielectric constants. We believe that the solvent should comprise between 10% and 60% by weight of the total polymeric gel, and the polymer should comprise between 40% and 90% by weight.

Figure 3:
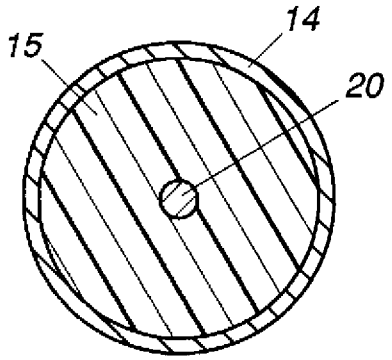
FIG. 3 is a cross sectional view of FIG. 1 taken horizontally through the center.

Referring to FIG. 3, a horizontal cross-sectional view of the antenna depicted in FIG. 1 is shown. As can be seen, the radiating element 20 is surrounded on all sides by the high dielectric constant gel 15, and the gel is further surrounded by the cover 14.

Referring now to FIG. 4, a block diagram of a communication device containing an antenna in accordance with the invention is shown. The transmitter 40 is used for the transmission of signals received through a microphone 42. A receiver 41 couples received signals to a speaker 43. The antenna 10 is coupled to the transmitter 40 and the receiver 41 through a coupler 48. This coupler 48 provides for switching between the transmitter 40 and the receiver 41 when directed by controller 44.

In summary, an antenna with absorptive electromagnetic shield is constructed by enclosing the radiator in a polymer casing having an exterior and an interior section. The interior section is filled with a high dielectric constant polymeric gel. Any presently available antennas such as sleeve dipole, end-fed, quarter wave whip may take advantage from the principles of the present invention. By using a radiator which is surrounded by a high dielectric constant material, an antenna may be constructed that will be smaller and more efficient than a conventional antenna. While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. An antenna, comprising:

a radiating element having a length for radiating a radio frequency energy;

a polymeric gel having a dielectric constant greater than 5 and surrounding the radiating element along the length, the polymeric gel comprising a polymer having a polar functional group and comprising a polar organic solvent having a dielectric constant greater than 20 dispersed throughout the polymer; and a cover encasing the polymeric gel.

2. The antenna as in claim 1, wherein the polymeric gel further comprises a non-polar polymer.

3. The antenna as in claim 2, wherein the non-polar polymer is polyethylene, polypropylene, polytetrafluoroethylene or dimethylpolysiloxane.

4. An antenna as in claim 1, wherein the radiating element is a straight conductor, a braided conductor, a metal foil conductor or a helical conductor.

5. An antenna as in claim 1, wherein the cover is one or more polymers selected from the group consisting of polyethylene, polypropylene, silicones, polystyrene, polyurethanes, isocyanurates, ionomers and polyesters.

6. The antenna as disclosed in claim 1, wherein the polar organic solvent comprises between 10% and 60% by weight of the polymeric gel.

7. The antenna as disclosed in claim 1, wherein the polymer comprises between 40% and 90% by weight of the polymeric gel.

8. The antenna as disclosed in claim 1, wherein the polar organic solvent has a dielectric constant between 20 and 200.

9. The antenna as disclosed in claim 1, wherein the polar functional group is selected from the group consisting of acetamides, alcohols, carbonates, anhydrids, carboxylic acids, esters, imides and amides.

10. The antenna as disclosed in claim 1, wherein the polar organic solvent contains a hydroxyl, amide, nitrile, carbonate, sulfate or sulfoxide group.

11. The antenna as disclosed in claim 1, wherein the polar organic solvent is one or more solvents selected from the group consisting of acetamide, acetonitrile, acrylonitrile, bis (2-hydroxyethyl) ether, 1,3-butanediol, 1,4-butanediol, 3-butenenitrile, N,N-dimethylacetamide, N,N-dimethylformamide, dimethyl sulfate, dimethyl sulfoxide, ethylene carbonate, formamide, glycerol, lactonitrile, N-methylacetamide, N-methylformamide, N-methylpropionamide, phthalide, propylene carbonate, tetrahydrothiophene oxide, and xylitol.

12. The antenna as disclosed in claim 1, further comprising a compatibilizing agent to aid in dispersing the polar organic solvent throughout the polymer.

13. An antenna for use with a portable communications device, comprising a radiator element encapsulated with a gel, the gel consisting of a polar organic solvent having a dielectric constant greater than 20 dispersed throughout a compatible polymer matrix containing a polar functional group.

14. A communication device, comprising:

a radio transmitter section for transmitting a radio frequency signal at a desired power; and an antenna coupled to the transmitter section for radiating the radio frequency signal to produce radiated energy, the antenna comprising:

a radiating element coupled to the transmitter section, the radiating element having a length along which radio frequency energy generated by the transmitter is radiated;

a polymeric gel encasing the radiating element along the length;

said polymeric gel having a dielectric constant greater than 5, and comprising a polar organic solvent having a dielectric constant greater than 20 dispersed throughout a compatible polymer matrix containing a polar functional group; and a cover surrounding the polymeric gel.

* * * * *